US005211568A

United States Patent [19]

Yamada et al.

[11] Patent Number: 5,211,568

[45] Date of Patent: May 18, 1993

[54] EDGE CARD CONNECTOR WITH LATCH/EJECT MECHANISM

[75] Inventors: Shoji Yamada, Machida; Yoshihisa Yamamoto, Yokohama, both of Japan

[73] Assignee: Molex Incorporated, Lisle, Ill.

[21] Appl. No.: 840,245

[22] Filed: Feb. 24, 1992

[51] Int. Cl.[5] ..... H01R 13/62

[52] U.S. Cl. ..... 439/157; 439/153

[58] Field of Search ..... 439/630–636, 439/152–160, 62, 65

[56] References Cited

U.S. PATENT DOCUMENTS

| | | | |
|---|---|---|---|
| 4,083,616 | 4/1978 | McNiece et al. | 439/157 |
| 4,579,408 | 4/1986 | Sasaki | 339/45 M |
| 4,698,024 | 10/1987 | Maxwell | 439/160 |
| 4,740,164 | 4/1988 | Schulz et al. | 439/157 |
| 4,898,540 | 2/1990 | Saito | 439/153 |
| 4,990,097 | 2/1991 | Billman et al. | 439/160 |
| 5,017,149 | 5/1991 | Hatanaka | 439/157 |
| 5,074,800 | 12/1991 | Sasao et al. | 439/157 |
| 5,106,315 | 4/1992 | Billman et al. | 439/160 |

*Primary Examiner*—David L. Pirlot

[57] ABSTRACT

A connector for an edge card which includes a plurality of contact terminals spaced apart in an elongated connector housing has a single, latch/eject mechanism rotatably disposed at one end thereof which securely latches the edge card in place within the connector housing and which, when actuating force is applied thereto, partially ejects one end of the edge card out of the connector housing to allow the edge card to be "zippered" out of the connector. The mechanism includes a member having two upwardly extending engagement arms. The member is rotatable between two positions: a first position wherein the edge card is held by the member in a spaced between the two engagement arms and a second position wherein the member partially urges the edge card out of the connector housing.

20 Claims, 6 Drawing Sheets

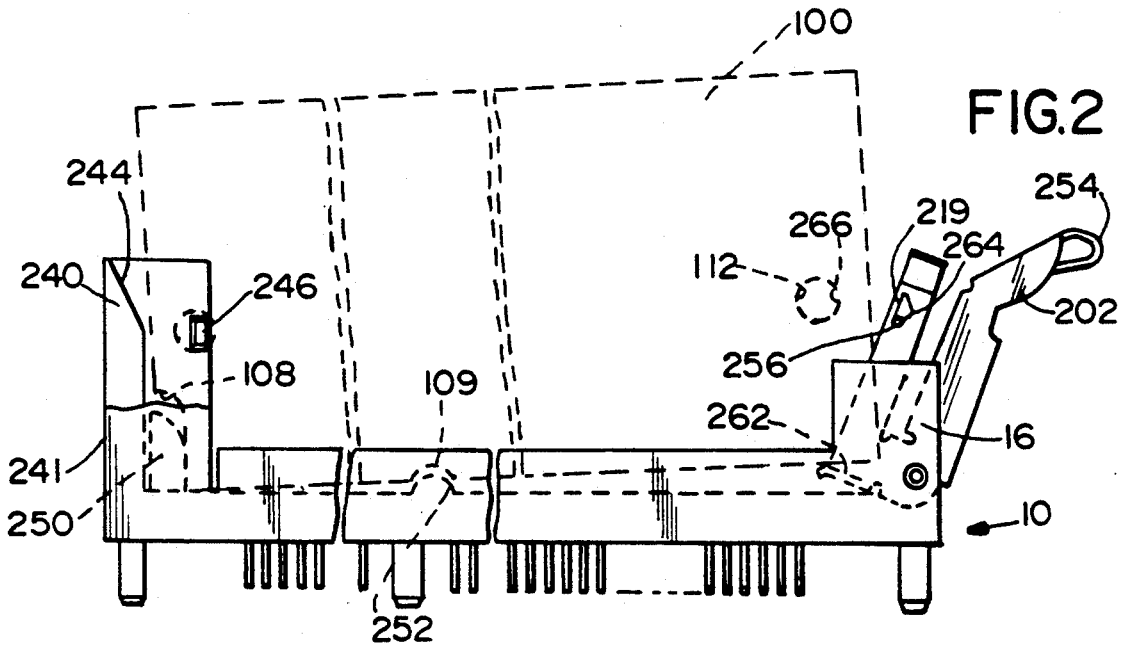
FIG.2
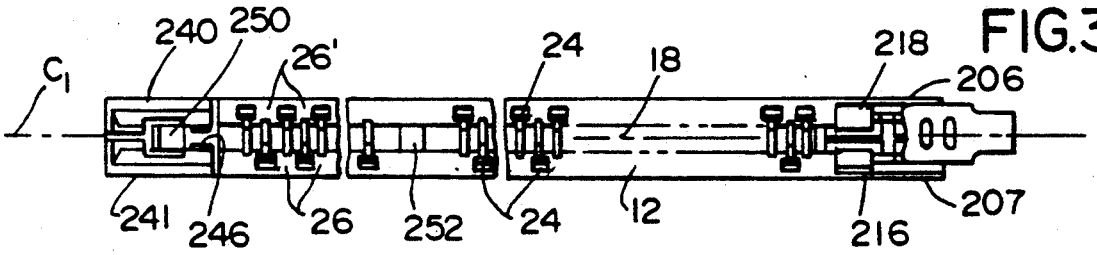
FIG.3
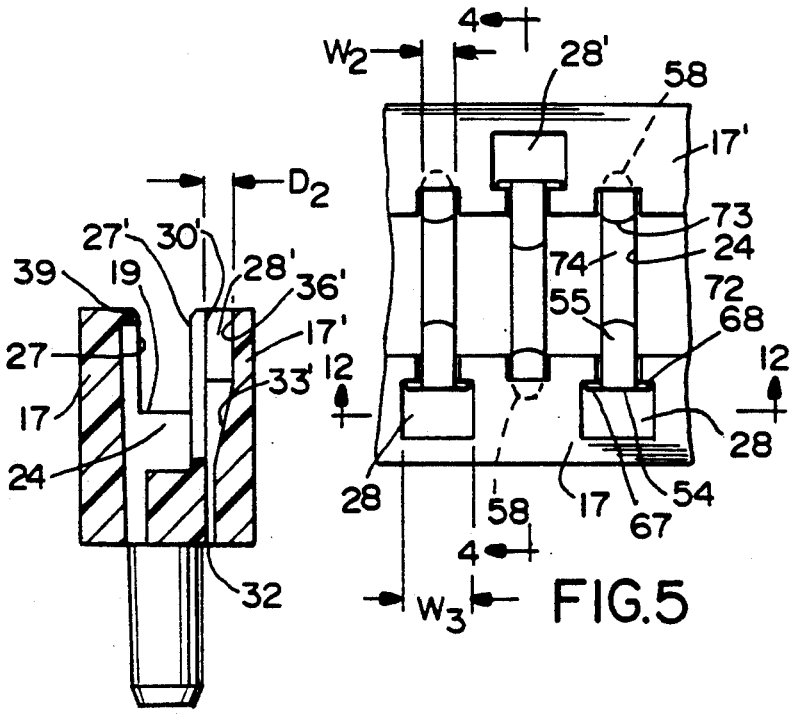
FIG.4
FIG.5

EDGE CARD CONNECTOR WITH LATCH/EJECT MECHANISM

BACKGROUND OF THE INVENTION

The present invention relates generally to edge card connectors, and more particularly to an edge card connector which has a plurality of generally U-shaped contacts and having a rotatable latch/eject member which, in one position, retains the edge card in place within the connector and, in another position, partially ejects the edge card from the connector.

Many electrical circuits, especially those used in the computer arts, are presently formed on one or more surfaces or levels of circuit boards, or similar substrates, to form separate circuits which may be added to computers or other electronic devices after initial manufacture thereof to improve the performance thereof. Whether such circuits are added during the initial manufacture or afterwards, these separate circuit boards must be reliably connected to the main computer printed circuit board, commonly referred to in the art as a "mother" board. The separate printed circuit boards are commonly referred to as "daughter" boards.

Connectors have been developed in the computer art which are designed for permanent installation on the mother board. These connectors contain a means for receiving the daughter board, such as a slot, to provide a connection between the mother board circuitry and the daughter board additional circuitry. These daughter boards are also descriptively referred to as "edge cards" because one side, or edge, of the card contains a plurality of relatively wide contact portions known as contact pads. The edge of the circuit card typically contains a plurality of these contact pads disposed thereon which extend laterally along one edge. One or both of sides of the edge card may contain such contact pads. This edge containing the contact pads is inserted into a slot of the connector which typically includes a number of electrical contact portions which may be similarly disposed along one or more sides of the connector slot in a manner to oppose the edge card contact pads. The connector contacts may typically include a tail portion, which projects from the connector for interconnection to the circuitry of the mother board positioned beneath or adjacent the connector. These ends are connected to the mother board by suitable means such as soldering to form an electrically conductive connection between the mother board and the edge card connector. Each connector contact further includes an edge card contact portion which is arranged within the card slot in a manner to abuttingly contact the edge card contact pads to provide an electrical connection between the edge card and the mother board.

Edge card connectors are well known in the art. In many of these edge card connectors, the connector may include either an edge card latching apparatus which holds the edge card in place within the connector after insertion thereof, or it may include an edge card extraction or ejection apparatus which permits a user to eject the edge card from the connector card slot. Such connectors are appropriately described in U.S. Pat. No. 4,990,097, issued Feb. 5, 1991 and U.S. Pat. No. 5,074,800 issued Dec. 24, 1991.

These type of edge card connector suffer from certain disadvantages. For example, the apparatus described in the aforementioned patents require their operative members to be oriented in a certain position, such as an open position before an edge card may be inserted into the connector card slot without interference from the latch or eject apparatus. Such a construction would not permit efficient automated assembly of mother boards using such connectors in that all connectors would need to be inspected to verify their operative positions prior to insertion of an edge card.

Accordingly, a need exists for an edge card connector having a reliable latch/eject mechanism operatively disposed within a portion of the connector housing whereby the latch/eject mechanism communicates with the connector card slot and which mechanism permits insertion of an edge card therein regardless of the orientation of the mechanism, and which mechanism will reliably retain the edge card in place within the card slot after insertion.

SUMMARY OF THE INVENTION

The present invention is therefore directed to an edge card connector which offers significant advantages over the connectors described above, and which is reliable and which permits the insertion on an edge card into the connector card slot whether the latch/eject mechanism is an open or closed position. Such an edge card connector permits automated insertion of secondary printed circuit cards into connectors mounted on a primary printed circuit board.

In one principal aspect, the present invention accomplishes these advantages by providing an edge card connector in which the connector body includes a latch/eject mechanism associated therewith and rotatably mounted thereon at one end thereof, wherein the latch/eject mechanism rotates between first and second operative positions. The latch/eject mechanism includes a manually manipulatable actuating portion having two engagement arms which extend upwardly from a base portion thereof to define a circuit card-receiving space therebetween. The engagement arms each include a lead-in portion which assists in guiding the circuit card into the card-receiving space, regardless of the orientation of the latch/eject mechanism.

In yet another principal aspect of the present invention, each engagement arm includes a boss member which projects inwardly into the card-receiving space between the engagement arms. A hole is punched through the engagement arm adjacent and beneath each such embossment to provide the boss member and engagement arm with an abrupt edge which positively engages an edge card opening and which positively engages the edge card in a manner which generally resists removal of the card from the connector unless the card is properly "zippered" out of the connector by using the latch/eject mechanism.

BRIEF DESCRIPTION OF THE DRAWINGS

In the course of this description, reference will be made to the attached drawings in which:

FIG. 2 is an elevational view of the edge card connector of FIG. 1 showing an edge card in phantom partially inserted into the card slot;

FIG. 3 is a plan view of the edge card connector of FIG. 1;

FIG. 4 is a cross-sectional view of the connector of FIG. 5, taken along lines 4—4, but with the contact terminals removed from the contact-receiving cavities;

FIG. 5 is an enlarged plan view of a portion of the connector housing of FIG. 1 showing the contact terminals in place within their cavities;

DETAILED DESCRIPTION OF THE INVENTION

Figure 1:
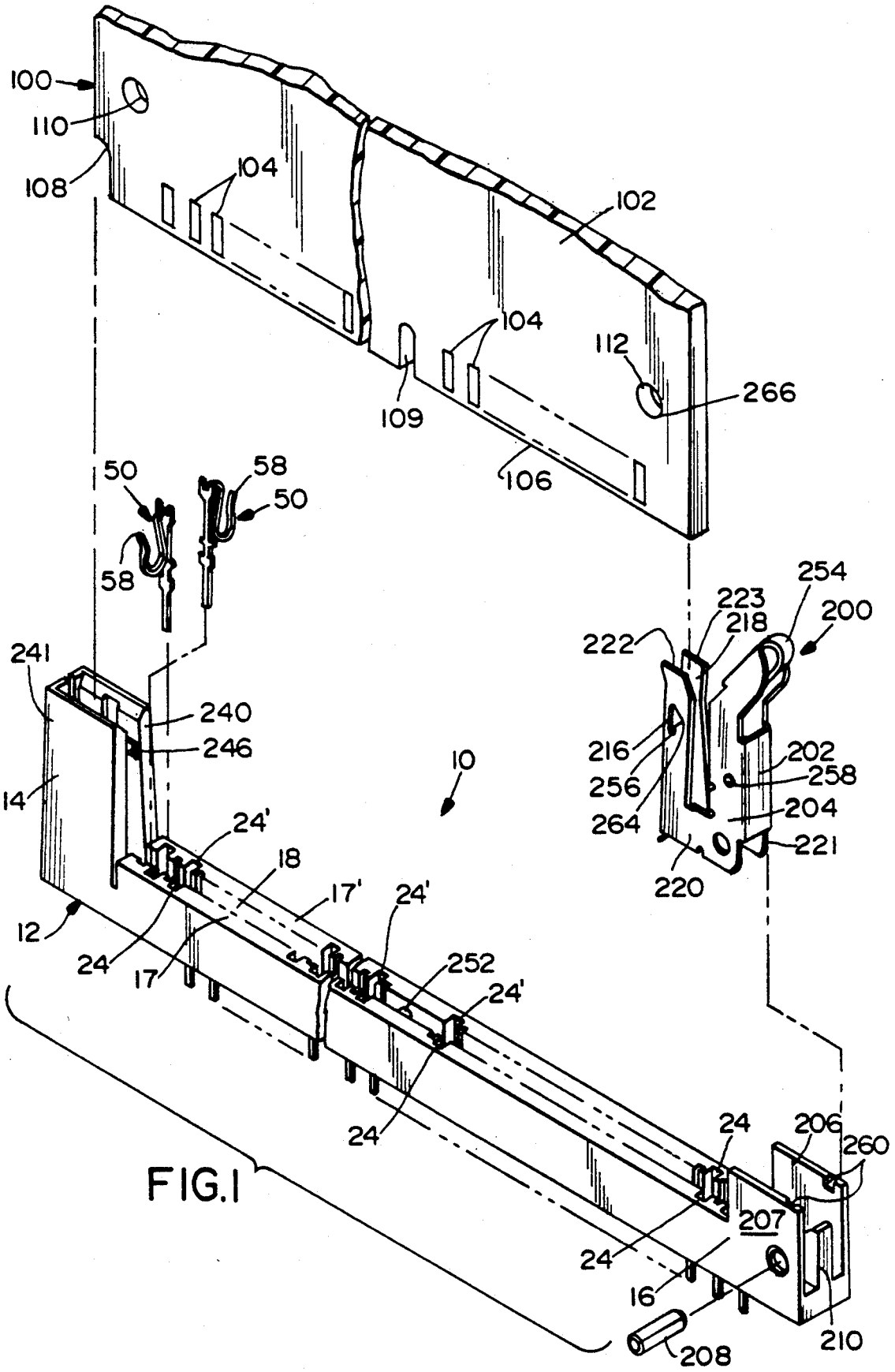
FIG. 1 is an exploded perspective view of an improved edge card connector constructed in accordance with the principles of the present invention.

FIG. 1 illustrates an exploded edge card connector, generally indicated at 10, constructed in accordance with the principles of the present invention which includes terminals, indicated generally at 50, and a latching/eject lever, indicated generally at 200, shown with a mating edge card, indicated generally at 100. As shown, the edge card 100 is received within card slot 18 of the connector 10. The edge card 100 may be conventional in nature, having a substrate 102 and a plurality of electrical contact pads 104 aligned along a marginal edge 106 of the edge card 100 and connected to electrical traces (not shown) on or in the card 100. The edge card has contact pads 104 on both sides thereof that are electrically connected to one another to provide redundant contact surfaces which improves the reliability of the edge card/electrical connector interconnection. Edge 106 is designated for insertion into the card slot 18 of the connector 10, as described below. The edge card 100 may further include a means for polarizing the card 100 properly within the connector 10 in the form of a polarizing notch 108 which interacts with projection 250 to prevent a card 100 from being rotated 180° and inserted into the card slot 18. The card 100 may further include one or more openings 110, 112 which are designed to receive, engagement means such as protruding bosses, when the edge card 100 is inserted into place within the card slot 18. The edge card 100 may also include a slot 109 that interacts with a like configured projection 252 in card slot 18 to center the edge card 100 longitudinally so that the contact pads 104 thereof are aligned with their respective contact terminals 50. The edge card 100 may have mounted thereon a plurality of electronic components such as integrated circuits, or memory modules (not shown).

As shown in FIG. 1, the connector 10 includes an elongated connector body, or housing portion, indicated generally at 12, which extends between two opposing end portions 14 and 16. The connector 10 includes an elongated slot, or channel, 18 which extends longitudinally between the opposing end portions 14, 16. The channel 18 is generally defined by two spaced-apart connector housing sidewalls 17, 17' and a connector housing floor 19. (FIG. 3) The sidewalls 17, 17' are generally parallel to each other. The connector housing 12 is formed from an insulative material by a conventional process, such as injection molding. When viewed in cross-section (FIG. 4), the connector housing sidewalls 17, 17' and floor 19 impart a general U-shaped configuration to the connector housing 12.

Figure 6:
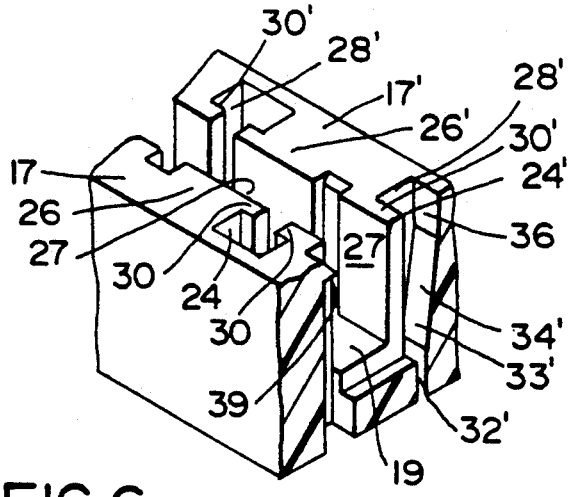
FIG. 6 is a perspective view, in section, showing a portion of the connector housing of the connector of FIG. 1, without the contact terminals in place.

As best seen in FIGS. 5-8, the connector housing 12 includes a plurality of contact-receiving cavities 24 associated with the card slot 18. Each cavity includes an enlarged recess 28 or 28' at one end thereof. The cavities 24 are generally oriented transversely to the channel 18 in side-by side order between the connector opposing end portions 14, 16. (FIG. 5) The cavities 24 are arranged in an alternating fashion such that the enlarged recess 28 or 28' of each cavity is on the opposite side of card slot 18 when compared to the enlarged recesses 28', 28 of its adjacent cavities 24. In this regard, throughout this detailed description, a reference numeral having a prime will refer to an element located on one side of the connector housing longitudinal centerline $C_1$ (FIG. 3) which has a corresponding element located on the opposite side of the centerline. The cavities 24 are separated from each other in a predetermined spacing or pitch by a plurality of partition walls 26, 26' (FIGS. 5, 6). The partitions 26, 26' serve to define interior surfaces 27, 27' of the housing sidewalls 17, 17' which in turn, define card slot 18.

Figure 7:
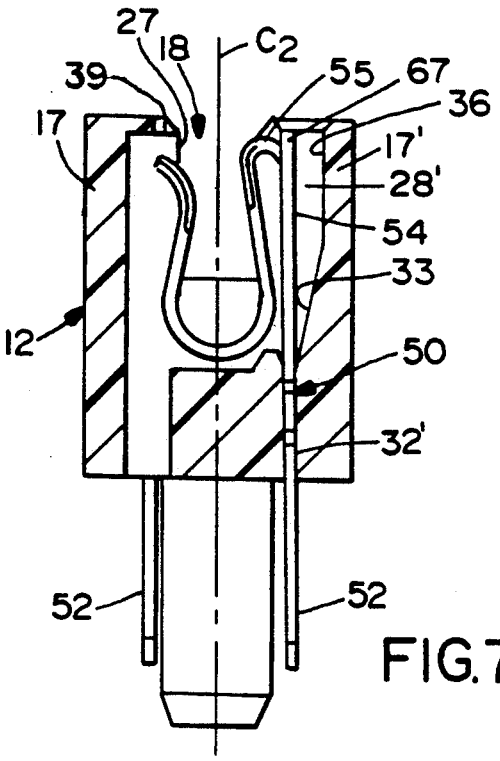
FIG. 7 is a cross-sectional view similar to that of FIG. 4 illustrating a contact terminal in place within a contact-receiving cavity of the connector housing.
Figure 12:
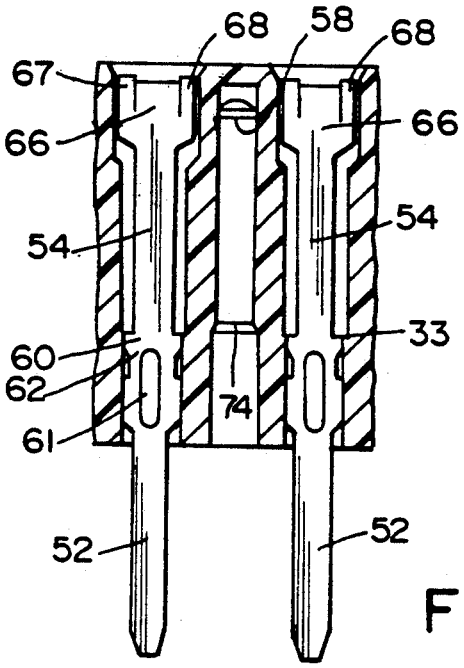
FIG. 12 is a partial sectional side view taken along line 12—12 of FIG. 5 showing the contact terminals in place within the connector housing.

Turning now to FIGS. 6 and 7, each cavity 24 extends within the connector sidewalls 17, 17' and the floor 19 to define a space which receives at least a portion of the contact terminal 50. Each cavity 24 also includes an aperture 32 which extends downwardly through the connector housing 12 and floor 19. The aperture 32 receives a base or solder tail portion 52 of the contact terminal 50. The aperture 32 retains the contact terminal 50 in an interference fit within the cavity 24 as further described below with reference to FIG. 12. Each cavity 24 further has a vertically defined enlarged extension or recess portion 28. Each recess 28 has a width $W_3$ which is greater than the width $W_2$ of the contact cavity 24. Recess 28 may also have a slightly narrower portion 29 (FIG. 12). This width differential defines a pair of stop walls 30, 30' (FIGS. 4, 6) at the interface of each recess 28 and its associated cavity 24 (FIG. 6), the purpose of which is explained in greater detail below.

Turning now specifically to FIG. 4, each recess 28' extends from above the solder tail aperture 32' and extends upwardly through the sidewall 17'. A lower wall 33' of the recess 28' extends upwardly from the aperture 32 at a slight angle and defines an inclined ramp of the recess 28'. The ramped wall 33' extends for a preselected distance and terminates in vertical endwall 36. The lateral extent $D_2$ of the recess, which is the distance between the stop wall 30' and the endwall 36' preferably permits movement therein of a portion 54 of the contact terminal 50. Ramp 33' is inclined to guide the solder tail 52 into aperture 32' during loading of the terminals 50 into the housing 12, such loading occurring from the top of housing 12. In addition, ramp 33' may act as a stop surface during the deflection of the terminal 50. The cavities 24, the recesses 28, 28' and the housing sidewalls 17, 17' may include chamfers which serve to guide the terminal tail portion 52 into the housing apertures 32, 32'.

Figure 10:
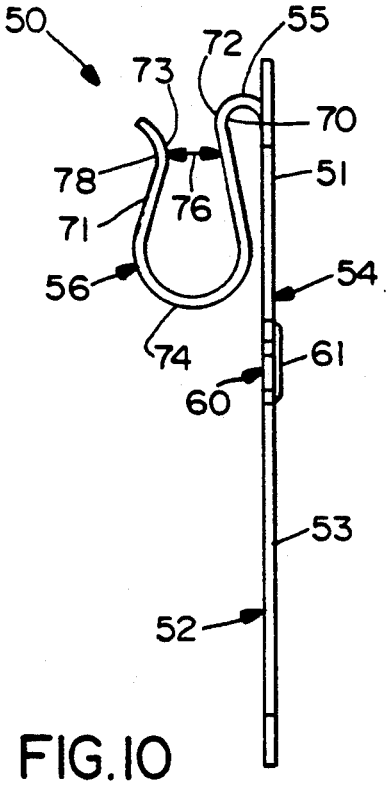
FIG. 10 is an end view of a contact terminal used in the connector of FIG. 1.
Figure 11:
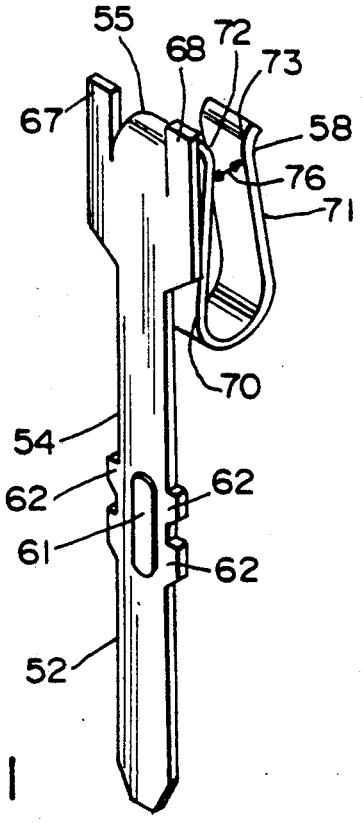
FIG. 11 is a perspective view of the contact terminal of FIG. 10.
Figure 13:
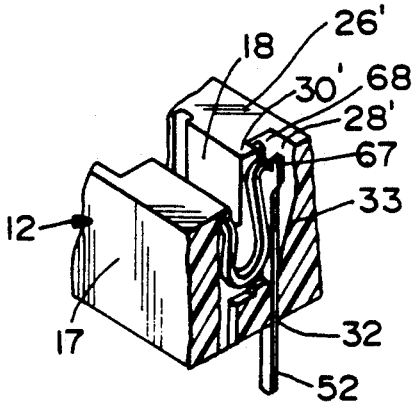
FIG. 13 is a perspective view of a portion of the connector of FIG. 1 showing the contact terminal in place within the connector housing.

As shown in FIGS. 10 and 11, the contact terminal 50 is formed from a single sheet of relatively thin electrically conductive metal, such as beryllium copper or phosphor-bronze. One or more portions of the contact terminal may be plated with an oxidation-resistant material such as gold to improve the conductivity thereof. The terminal solder tail portion 52 extends upwardly and is integrally joined to a generally vertical, cantilevered positioning portion 54 which, in turn, is integrally joined by a generally horizontal transition portion 55 to a contact portion 56. The solder tail portion 52 is adapted to engage the primary circuit board in known manner.

The terminal positioning portion 54 extends upwardly from the solder tail portion 52 at a relatively wide reinforced area 60 which may include one or more outwardly extending barbs 62 which are adapted to engage surfaces 64 of the apertures 32 in an interference fit after insertion of the contact element 50 into the cavity 24. (FIG. 12) The reinforced area 60 preferably includes an embossment 61 disposed therewithin. The embossment 61 serves to increase the section modulus of this area of the terminal 50, thereby increasing the stiffness of this area to increase the resistance thereof to stresses imparted during insertion of the terminal 50 into the cavity 24.

The terminal positioning portion 54 extends generally vertically within the recess 28 when inserted into the contact cavity 24. Because of the lateral extent $D_2$ of recess 28, the positioning portion 54 is able to deflect within the recess 28 when a circuit card 100 is inserted into the card slot 18. (FIGS. 8, 9) The positioning portion 54 has an increased width where the positioning portion 54 and transition portion 55 are joined together which defines two projections 67, 68 from the positioning portion 54. These projections 67, 68 engage the recess shoulder walls 30 to limit the movement of the contact terminal 50 into the card slot 18 during insertion of the circuit card 100 into the card slot 18. The interaction between projections 67, 68 and stop walls 30 limits the extent to which the first, or upper, contact surface 72 protrudes into the channel 18 to substantially reduce the possibility of stubbing the same with the bottom edge 106 of circuit card 100. If desired, projections 67, 68 could be used to preload the terminal 50 up against shoulder walls 30.

The transition portion 55 of the contact terminal 50 extends generally horizontally outwardly from the positioning portion 54 in a cantilevered manner. The transition portion 55 connects the contact portion 56 to positioning portion 54. The contact portion 56 is formed, after stamping, into a general U-shape in which the U-portion thereof has two opposing contact arms 70, 71 disposed on opposite sides thereof with bight 74 therebetween. The contact arms 70, 71 include contact surfaces 72, 73 on their protruding surfaces which are formed by coining.

Coining changes the cross-sectional profile of the contact surfaces from a flat planar surface to a relatively curved surface having a raised central portion. The raised, central portion provides a contact surface having a reduced area as compared to a flat surface. A curved contact surface requires less contact force in order for the contact terminal 50 to exert a desired, predetermined pressure against the contact pads 104 of the card 100. The opening 76 should be dimensioned smaller than the width of an edge card 100 that is to be inserted into the connector to ensure deflection of both arms 70, 71 and thus good contact between contact surfaces 72, 73 and contact pads 104 of the edge card.

The first contact arm 70 extends from the transition portion 55 and curves downwardly and away from the vertical centerline $C_2$ (FIG. 8) of the card slot 18 along a preselected radius until it reaches a bight 74 which interconnects the first contact arm 70 with the second contact arm 71. The second contact arm 71 extends upwardly from the bight 74 and inwardly toward centerline $C_2$ until reaching end 58 which then curves outwardly from centerline $C_2$. The two contact arms 70, 71 define an edge card receiving opening 76 between them. (FIG. 10) This opening 76 increases in width from the contact surfaces 72, 73 down to the bight 74 and assists in imparting the preferred spring characteristics to the contact portion 56 which ensures a reliable electrical connection between the terminal 50 and the edge contact pads 104 of the circuit card 100.

Contact surfaces 72, 73 are at different heights relative to the top of the housing 12 prior to insertion of an edge card to stagger the deflection forces and thus reduce the peak insertion force. As best seen in FIG. 7, a portion of the free end 58 of the terminal 50 extends beneath the ledge portion 39 when the contact terminal 50 is in an unmated, or undeflected, position. This prevents the bottom edge 106 of the card 100 from stubbing the free end 58 of the second contact arm 72 which could damage the terminal 50.

When assembled, the solder tail portion 52 is anchored in the contact cavity aperture 32 by its engagement barbs 62 (FIGS. 11, 12). The positioning portion 54 extends vertically within the contact cavity recess 28 (FIG. 7), while contact surfaces 72, 73 extend into the card slot 18. The distance that the first contact arm 70 extends into the card slot 18 is limited by the engagement of the contact element positioning shoulders 67, 68 with the connector housing recess shoulder walls 30.

Figure 8:
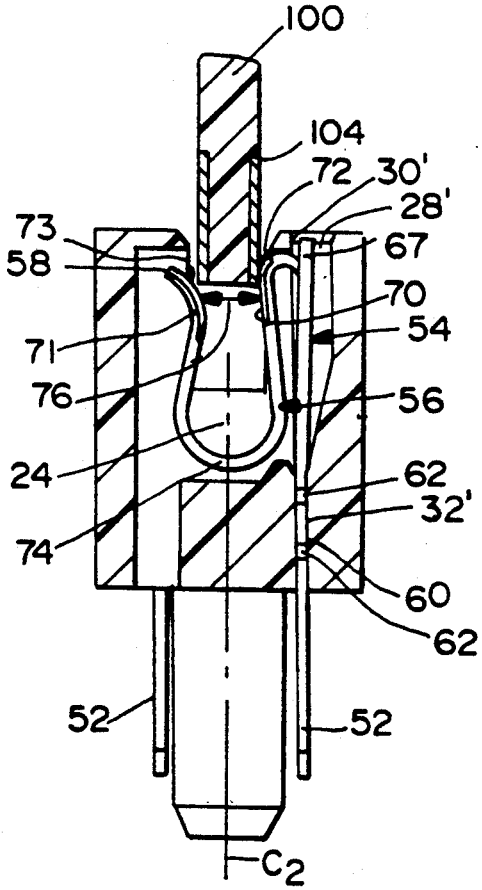
FIG. 8 is the same view as FIG. 7 showing an edge card initially inserted into the card slot.
Figure 9:
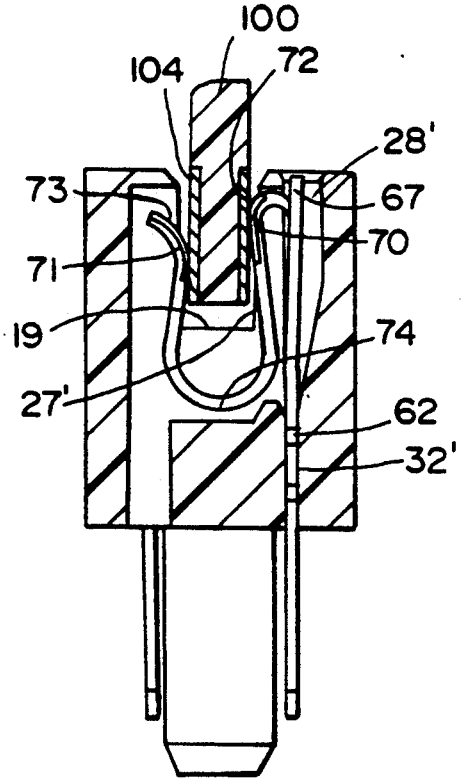
FIG. 9 is the same view as FIG. 8 showing the edge card further inserted into the connector housing slot.

FIGS. 7–9 illustrate best the manner of deflection of the contact terminal 50 from an undeflected position prior to insertion of the card 100 into the card slot 18 (FIG. 7) to an initial deflected position where the card is partially inserted into the card slot 18 (FIG. 8) to a completely deflected position where the card 100 is fully inserted into the card slot 18. (FIG. 9) When an edge card 100 is inserted into the card slot 18 as shown in FIG. 8, the marginal edge 106 having the contact pads 104 slidingly engages the curved contact surface 72 of the first contact arm 70. The contact terminal positioning portion 54 is free to move within the connector housing recess 28' and deflects away from the card slot centerline $C_2$ within the recess 28', such that it partially pivots relative to the tail portion 52 about the reinforced area 60. This deflection urges U-shaped contact portion 56 to the right as viewed in FIG. 8 to force the second contact arm 71 further into the card slot 18. Further insertion of the edge card 100 into the connector body channel 18 causes the contact arms 71 to deflect outwardly away from centerline $C_2$ and appropriately contact the edge card 100 at the contact pad portions 104 thereof. By virtue of the spring characteristics of the contact arms 70, 71, the coined contact surfaces 72, 73 react to apply a desired normal force to the edge card 100. Terminal positioning portion 54 also exerts a lateral force on the circuit card 100, which combines with the normal forces of the terminal contact arms 70, 71 to bias the card toward the center of card slot 18. Because of the alternating orientation of the cavities 24 and thus the contact terminals 50 therein, and the biasing nature of the terminals, the connector 10 may accommodate circuit cards which are warped or bowed approximately 0.29 mm from the centerline $C_2$. Accordingly, a circuit card having warpage within the above described tolerance will tend to flatten out when properly mated with the connector 10.

Because the contact terminal 50 is stamped and formed and because of its configuration within housing 12, the overall width of the housing may be as small as 5.0 mm. This reduced spacing advantageously permits the connector 10 to be used with SIMMs, or other modules, having relatively thin chips thereon, thereby freeing up space for other circuit components on the primary circuit board. Connectors constructed in accordance with the present invention thus permit a reduction in spacing of adjacent connectors on the mother board of from over 7.0 mm to approximately 5.08 mm.

Since the contact arms 70, 71 are formed from the same single piece of sheet metal and contact pads 104 of the edge card that are laterally aligned are electrically connected, a redundant contact system is achieved when an edge card is mated with the connector 10.

Figure 16:
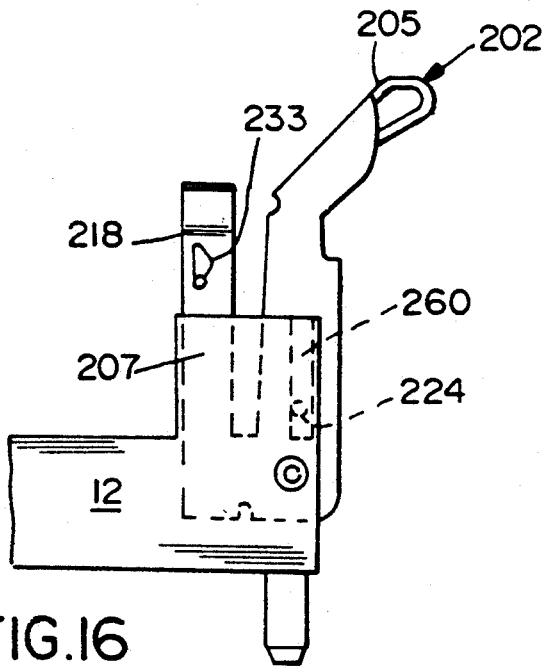
FIG. 16 is a partial elevational view of the connector of FIG. 1 showing the latch/eject mechanism of FIG. 1 in a latch position.
Figure 17:
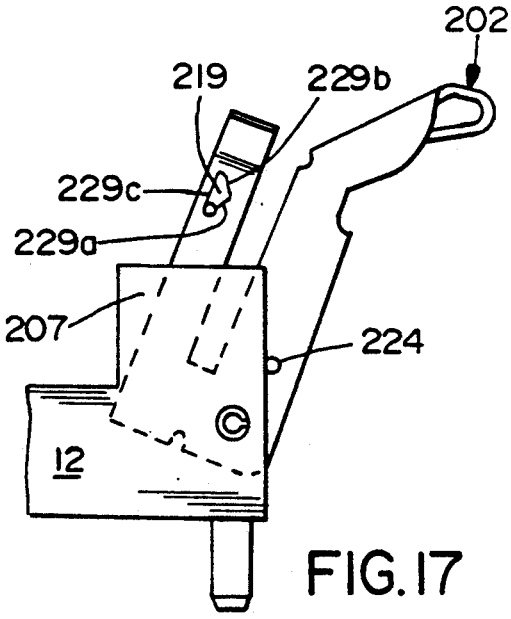
FIG. 17 is a partial elevational view of the connector of FIG. 1 showing the latch/eject mechanism of FIG. 1 in an eject position.
Figure 18:
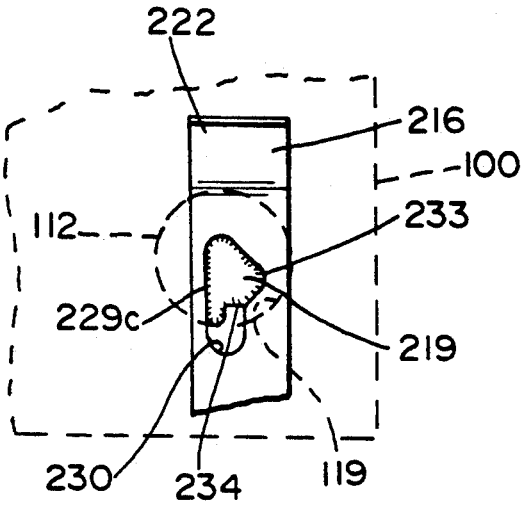
FIG. 18 is an enlarged partial view of the leftmost engagement arm of the latch/eject mechanism of FIG. 14 showing the engagement arm boss member in an engagement position with an edge card shown in phantom.
Figure 20:
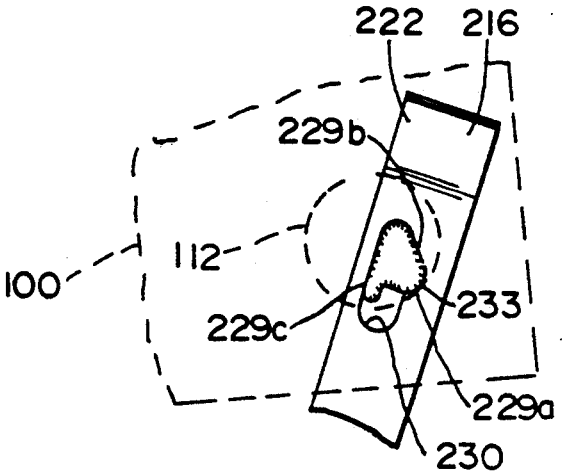
FIG. 20 is the same view as FIG. 18 showing the latch/eject mechanism of FIG. 1 in a latch position; and, FIG. 21 is the same view as FIG. 19, but showing the edge card partially rotated out of engagement with the latch/eject mechanism.
Figure 19:
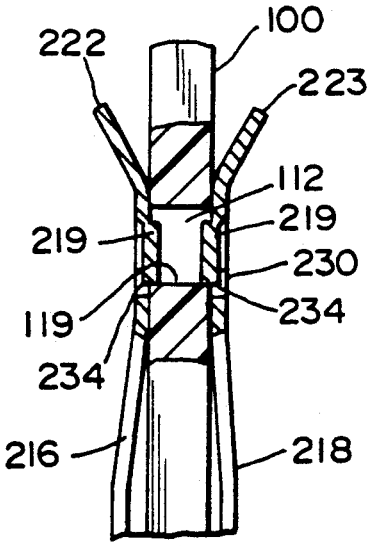
FIG. 19 is an enlarged cross-sectional view of the latch/eject member in an engaged position holding an edge card in place therein.
Figure 21:
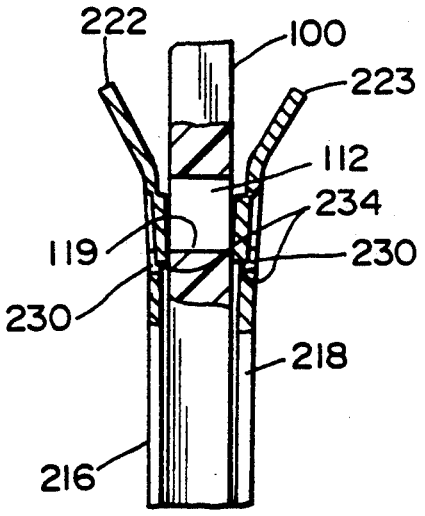

Returning to FIG. 1, the connector 10 may also include a latch/eject mechanism 200 pivotally mounted at an end 16 of the connector housing 12. The latch/eject mechanism 200 includes a latch member 202 stamped and formed, as shown, from a metal blank. The latch member 202 is held between two vertical extensions 206, 207 of the connector body 12 by a pivot pin 208 which extends through the connector body extensions 206, 207. A post 210 for centering and supporting the mechanism 200 may be located between the extensions 206, 207. Latch member 202 can be rotated between a latched position (FIGS. 16, 18 and 19) and an ejected position (FIGS. 17, 20 and 21) through the application of force to a manually manipulatable actuator portion 205.

Figure 14:
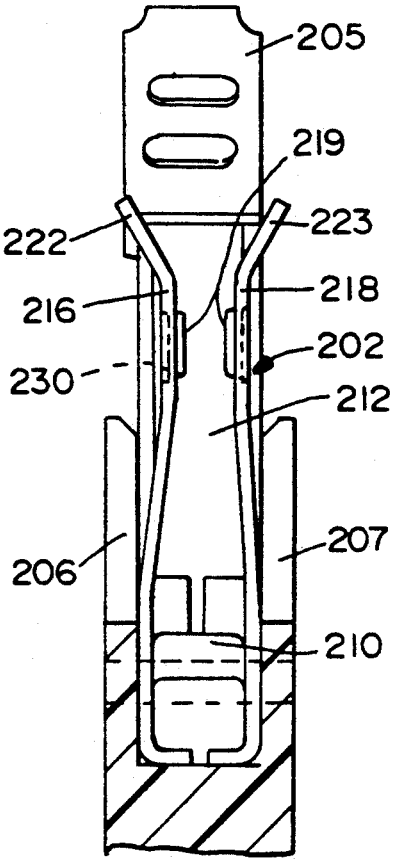
FIG. 14 is a sectional view of the connector of FIG. 1 and showing an end view of the latch/eject mechanism.

The latch member 202 includes two engagement arms 216, 218 extending upwardly in a cantilevered manner from respective base members 220, 221 in a spaced-apart relationship. The engagement arms 216, 218 are spaced apart and extend forwardly from the actuator portion 205. The two engagement arms 216, 218 define a card-receiving space 212 therebetween, and each such arm is preferably provided with an inwardly projecting, generally triangularly shaped boss 219, such as an embossment, (FIGS. 18 and 20) which is adapted to engage a similarly positioned opening 112 on the edge card 100. When viewed in end profile (FIG. 14), the engagement arms 216, 218 extend slightly inwardly toward each other and then outwardly to define lead-in portions 222, 223 which permit, because of their slope, an edge card 100 to be inserted into the mechanism 200 when the latch/eject mechanism is in a latched orientation. (FIG. 16) Importantly, the portion of the card-receiving space 212 directly beneath the neck 217 defined by the engagement arms 216, 218 is wide enough to permit the edge card 100 to be inserted into that card-receiving space portion when the latch member 202 is in an eject position. (FIG. 17) Consequently, the present invention lends itself to automated insertion of edge cards 100 into the connectors 10, regardless of the orientation of the latching mechanism 200.

The latch member 202 may also include one or more detents 224 which extend outwardly from the actuator portion 205 of the latch member 202 and which engage complimentary shaped recesses 260 disposed on the inner surfaces of the connector body extensions 206, 207 to retain the latch member 202 in a latched position.

Figure 15:
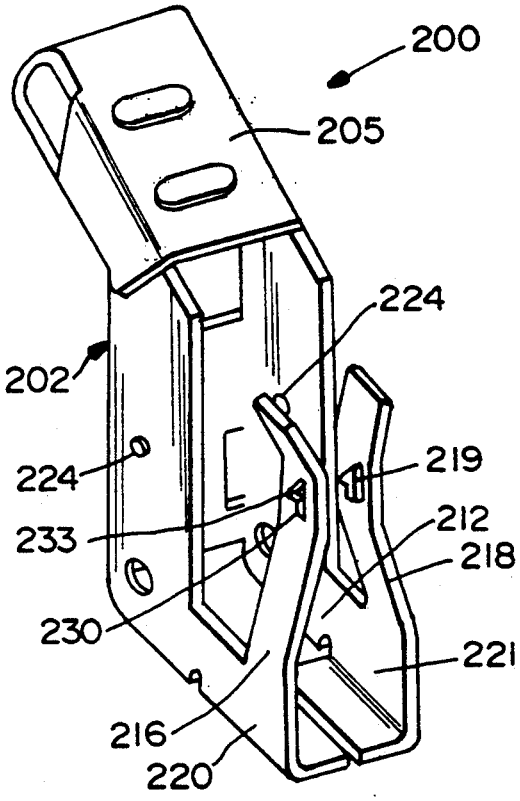
FIG. 15 is a perspective view of the latch/eject member of the connector of FIG. 1.

The engagement arms 216, 218 each have an opening 230 associated with their respective boss members 219 and disposed adjacent one side 232 thereof. As seen best in FIGS. 15, 18 and 20, the embossment 219 is generally triangular in shape. Since the boss member is an embossment 219, the sides **229*a–c* thereof will be slightly rounded or curved in cross-sectional profile. (FIGS. 19 and 21) The opening 230 in each engagement arm creates a generally abrupt edge 234 which positively engages the inner wall 119 of the edge card opening 112, in an interfering manner. As shown specifically in FIG. 19, the abrupt edge 234 interferes with the card engagement opening inner wall 119 if removal of the edge card 100 is attempted while the latching mechanism is in its latched position. However, upon rotating the latch member 202 toward its eject position, one tip, or corner 233, of the triangular boss 219 which is closest to the actuator portion 205 contacts the edge card engagement opening inner wall 119 to thereby cause the engagement arms 216, 218 to spread apart. (FIG. 21) Thus, the engagement arms ride up onto the boss member 219 and provides a sufficient clearance to permit edge card engagement opening 112 to pass over the abrupt edge 234 of the boss 219**.

At the opposite end 14 of housing 12, two additional extensions 240, 241 extend upwardly in a spaced-apart relationship to define an edge card entry slot 242 therebetween. The extensions 240, 241 preferably each include a downwardly sloped ramp 244 which directs the edge card 100 into proper orientation for insertion into the connector channel 18. Extensions 240, 241 may further include bosses 246 extending therefrom into the entry slot 242 between them that project into openings 110 when the card 100 is inserted into housing 12.

It will be seen that while certain embodiments of the present invention have been shown and described, it will be obvious to those skilled in the art that changes and modifications may be made therein without departing from the true spirit and scope of the inventions.

We claim:

1. A push/pull edge card connector for providing an electrical connection between a first plurality of contacts on a primary circuit member and a second plurality of contacts on a printed circuit card, the circuit card having the second plurality of contacts disposed on an edge thereof, the circuit card edge being insertable into and removable from the connector, said circuit card being generally planar in nature and having first and second circuit faces, each of the first and second circuit faces having a row of circuit card contacts generally parallel to and adjacent an edge of said circuit card, and wherein said connector includes means for mounting said connector to the circuit board, said connector comprising:

a connector housing formed from an electrically insulative material, the connector housing having a lower face adapted for positioning adjacent said primary circuit board and an upper face spaced-apart therefrom having an elongated card slot disposed therein and extending between two opposing end portions of said connector, the card slot being adapted to receive said circuit card edge therein in an electrically operative relationship, the connector housing further including a plurality of contact element-receiving cavities spaced apart along said card slot and at least partially communicating with said card slot, said card slot having a predetermined longitudinal centerline;

a resilient contact terminal disposed in each of said contact receiving cavities, each contact terminal including a tail for electrically and mechanically interconnecting said contact terminal to one of said first plurality of contacts of said primary member circuit portion, and a portion of each of said contact terminals protruding into said card slot for slidingly engaging one of said second plurality of contacts upon insertion of said circuit card into said card slot; and a latch/eject member rotatably positioned at one of said end portions of said housing and rotatably between a first position in which said circuit card is retained within said card slot and a second position in which at least a portion of said circuit card is ejected from said card slot, said latch/eject member including a pair of resilient, cantilevered arms for latching a circuit card in said card slot and an eject surface for at least partially ejecting said circuit card from said card slot, the resilient arms defining a card-receiving space therebetween, said resilient arms projecting away from a lower surface of said card slot when said latch/eject member is positioned at said first position and further including converging lead-in surfaces converging in an insertion direction of the printed circuit card which permits said circuit card to be inserted into said card slot when said latch/eject member is in either the first position or the second position.

2. The connector of claim 1, wherein said latch/eject member further includes a manually manipulatable actuator portion spaced apart and extending away from said resilient arms.

3. The connector of claim 1, wherein said latch/eject member includes a body portion interconnecting said resilient arms with a manually manipulatable actuator portion, the body portion including at least one detent which is engaged by a recess disposed in a portion of said connector housing, whereby said one detent retains said latch/eject member in said first position.

4. The connector of claim 1, wherein said latch/eject member includes a body portion and said resilient arms extend upwardly away from said body portion, said body portion further including an actuator portion spaced apart from said resilient arms, said actuator portion including manual actuating means to rotate said body portion between said first position and said second position.

5. The connector of claim 1, wherein said resilient arms include a pair of cantilevered members extending upwardly from a body portion of said latch/eject member, each of the resilient arms including an inclined portion extending toward said card-receiving space, the inclined portions cooperating to define a neck area of said latch/eject member, said latch/eject member further having a spaced-apart portion wherein said resilient arms are spaced apart from each other beneath said neck portion for a preselected distance which is greater than a thickness of said edge card, said latch/eject member inclined portions and said spaced apart portion comprising said lead-in means of said latch/eject member.

6. The connector of claim 1 wherein said converging lead-in surfaces are each located adjacent a free end of said cantilevered arms and said surfaces slope toward a line parallel to said insertion direction.

7. The connector of claim 1, wherein at least one of said resilient arms includes boss means extending into said card-receiving space, the one resilient arm further having an opening disposed adjacent to and intersecting with said boss means, whereby a positive engagement surface is formed at the intersection of said opening and said boss.

8. The connector of claim 7, wherein said latch/eject member further includes means for disengaging said positive engagement surface with said circuit card when said latch/eject member is rotated to said second position.

9. The connector of claim 7, wherein said latch/eject member is formed from metal and said boss means includes a generally triangular-shaped embossment having three distinct sides, said arm opening intersecting with a side of said embossment nearest said eject surface.

10. The connector of claim 7, wherein said boss means has a generally triangular shape.

11. In an electrical connector for providing an electrical connection between a plurality of card contacts on a circuit card generally adjacent a first edge thereof and a plurality of board contacts on a circuit board, said circuit card being generally planar and having first and second faces, said first and second faces each having a row of card contacts generally parallel to and adjacent to the circuit card first edge, said circuit card further including at least one engagement opening extending through said card, said connector including an insulative housing having a lower face for positioning adjacent said circuit board, an upper face having a card slot therein for receiving said circuit card first edge and a plurality of contact element receiving cavities spaced along the card slot and in communication therewith, said card slot having a longitudinal centerline, a resiliently deflectable contact terminal positioned in each of said contact receiving cavities, the connector further having combined means to latch said circuit card into said card slot and to eject at least a portion of said circuit card from said card slot, the improvement comprising, in combination:

the means to latch and eject said circuit card including a latch/eject member disposed at an end of said connector housing, the latch/eject member being rotatably mounted to said connector housing and rotatable between a first position and a second position, said latch/eject member including a body portion, two card-engagement arms extending upwardly from the body portion, the card-engagement arms being spaced apart from each other and defining a card-receiving spaced therebetween, said latch/eject member further including a base portion disposed beneath and defining a lower part of said card-receiving space, the base portion interconnecting said engagement arms with an actuator portion of said latch/eject member, each of said engagement arms having a card-engagement surface, the card-engagement surface having a boss extending into said card-receiving space and an opening extending through said engagement arm, the opening being disposed adjacent said boss and intersecting therewith to define an engagement surface of said boss which positively engages an inner surface of said circuit card engagement opening.

12. The electrical connector of claim 11, wherein said latch/eject member is from metal.

13. The electrical connector of claim 11, wherein said engagement arm opening and said boss cooperate to form an abrupt edge at said engagement surface.

14. The connector of claim 11, wherein said latch/eject member is generally U-shaped, one leg of said U-shape being a manually manipulatable actuator portion and the other leg of said U-shape being said card-engagement arms.

15. The electrical connector of claim 11, wherein said boss is generally triangular.

16. The electrical connector of claim 15, wherein said engagement arm opening is disposed in said engagement arm adjacent a leg of said triangular boss which faces said latch/eject base member.

17. The electrical connector of claim 11, wherein said boss is generally triangular in configuration and has three distinct sides, said engagement arm opening being disposed adjacent one of said distinct sides which faces said base member.

18. The electrical connector of claim 17, wherein said triangular boss one distinct side in a side nearest said base member.

19. The connector of claim 1, wherein said latch/eject member is generally U-shaped, one leg of said U-shape being a manually manipulatable actuator portion and the other leg of said U-shape being said resilient, cantilevered arms.

20. The connector of claim 19 wherein said converging lead-in surfaces are each located adjacent a free end of said cantilevered arms and said surfaces slope toward a line parallel to said insertion direction.

* * * * *